United States Patent [19]

Clinch et al.

[11] 4,244,053

[45] Jan. 6, 1981

[54] PRIVACY COMMUNICATION METHOD AND SYSTEM

[75] Inventors: Marvin R. Clinch, Oneida, N.Y.; Calvin R. Graf; Paul E. Martin, both of San Antonio, Tex.; Robert B. Fenwick, Palo Alto, Calif.

[73] Assignee: The United States of America as represented by the Secretary of the Air Force, Washington, D.C.

[21] Appl. No.: 73,812

[22] Filed: Sep. 10, 1970

[51] Int. Cl.[3] ..... H04K 1/00

[52] U.S. Cl. ..... 455/29; 179/1.5 FS; 455/26

[58] Field of Search ..... 325/32; 179/1.5 R, 1.5 F; 331/177, 178, 179; 375/1; 455/26, 29

[56] References Cited

U.S. PATENT DOCUMENTS

| | | | |
|---|---|---|---|
| 1,571,005 | 1/1926 | Hartley | 179/1.5 F |
| 2,448,055 | 8/1948 | Silver et al. | 179/1.5 R |
| 2,998,573 | 8/1961 | Beagles | 331/179 |
| 3,124,748 | 3/1964 | Webb, Jr. | 179/1.5 F |
| 3,155,908 | 11/1964 | Berman | 455/29 |
| 3,204,034 | 8/1965 | Ballard et al. | 179/1.5 R |
| 3,283,254 | 11/1966 | Hayne | 331/178 |
| 3,331,035 | 7/1967 | Strickholm | 331/178 |
| 3,493,865 | 2/1970 | Miller | 375/1 |
| 3,619,802 | 9/1971 | Lohrmann | 331/178 |
| 3,681,708 | 8/1972 | Olmstead | 178/22 |
| 4,066,964 | 1/1978 | Costanza et al. | 455/29 |

*Primary Examiner*—Howard A. Birmiel

*Attorney, Agent, or Firm*—Joseph E. Rusz; George Fine

[57] ABSTRACT

A privacy communication method and system which utilizes coherent, continuously changing frequencies for keyed, pulsed, and voice communications. A synthesized swept frequency or "chirp" signal imparts a privacy or secure communications capability to the communications signal by virtue of the random or pseudo-random nature of the transmitted signals which is programmed.

6 Claims, 28 Drawing Figures

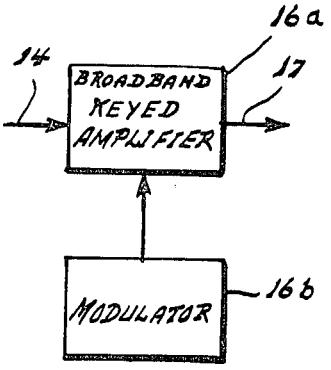
FIG. 2-a
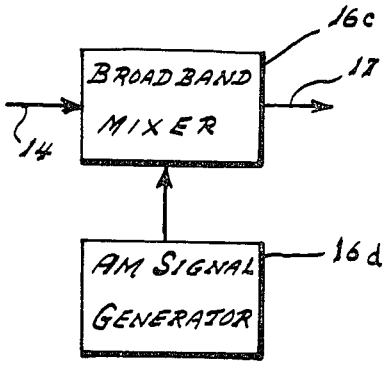
FIG. 2-b
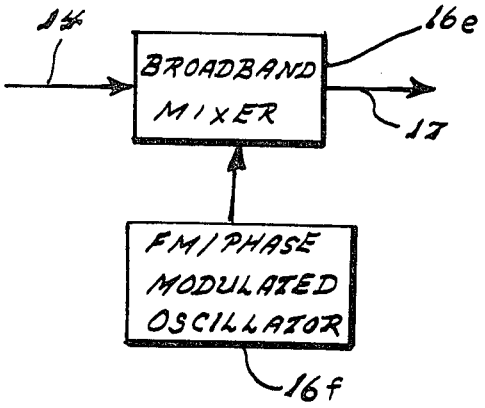
FIG. 2c
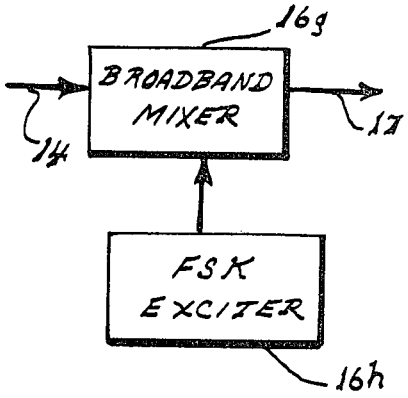
FIG. 2-d
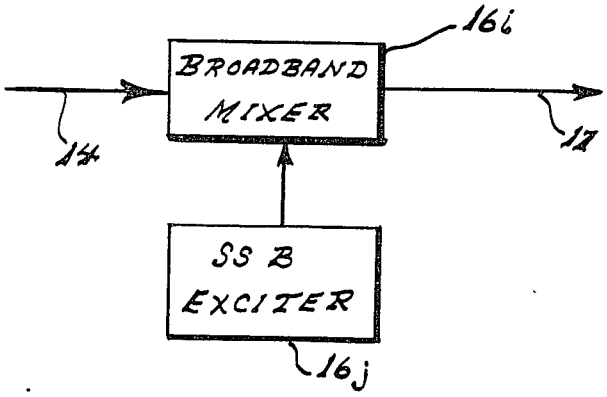
FIG. 2-e

PRIVACY COMMUNICATION METHOD AND SYSTEM

BACKGROUND OF THE INVENTION

This invention relates to communication methods and systems and more particularly a communication method and system providing privacy by virtue of its ability to change, on a coded, predetermined basis the time against frequency relationship of the transmissions on a continuous basis.

The "chirp" type of signal is one which continuously changes frequency with time according to some present relationship. In present "normal" use this signal is transmitted at one location and received at either the same location or at a different location for high frequency ionospheric propagation research purposes. However, the prior art does not include the utilization of a "chirp" type signal for the purpose of privacy in radio communication.

This invention solves the problem of generating a communications signal for use in the high frequency, very high frequency, or ultra high frequency range, with the following characteristics: all transmissions have a high degree of privacy or security for both pulsed and voiced communications circuits without the requirement for critical encryption techniques. Transmissions in the high frequency range where ionospheric propagation must be depended upon may be improved by the capability for determination of the optimum frequencies for operation. The detectability of the communications signals by unfriendly forces is low. The susceptibility of the communications signal to jamming and/or intentional interference is low. Finally, the susceptibility of the communications signals to position location by conventional direction finding equipment is greatly reduced.

This invention will be useful to the Air Force and others for providing secure, reliable, high quality communications from point-to-point. It will be useful for both ground-based, air, and shipborne uses. It will also be useful for command and control aircraft which must communicate over longer distances using the high frequency band. It will be useful to SAC for high frequency secure communications to manned bombers over long distances. When used with certain present forms of secure communications techniques, this invention will improve the security of the signal. Since this invention is jam-proof and virtually detection-proof, it will be useful for high reliability circuits. Since the signal is very difficult, if not impossible with the present state-of-the-art, to locate by direction finding techniques, clandestine operations by agents would be feasible.

SUMMARY OF THE INVENTION

This invention is a privacy communications method and system wherein the transmitter and receiver are at different locations. Intelligence is impressed upon the frequency varying (chirp) signal by either coded pulses (Morse code or mark-space frequency shift keying) or by voice modulation (amplitude modulation, frequency modulation, or single sideband suppressed carrier). Through a variation of the relationship of the sweeping signal with time in a random or pseudo-random fashion, a privacy or secure communications is imparted. The sweep frequency versus time relationship may be continuous-linear, continuous-nonlinear, intermittent-nonlinear, or a combination of these.

One of the features of this invention is the use of the equipment as an ionospheric sounder for use within the high frequency range to determine the best operating frequency band. By a simple interrogate-transpond technique, the communications equipment can determine its own frequency of operation (either automatically or on command of the operator). An added feature is that for a particular point-to-point communications path, only those frequencies very near maximum usable frequency could be selected so that unintended potential listeners would be placed in the so-called "skip" zone and would be unable to receive the signal.

One of the novel features of this invention is the provision of a privacy feature by virtue of the ability to change, on a coded, predetermined basis the time versus frequency relationship of the transmissions on a continuous basis. Another novel feature is the provision of a privacy feature by virtue of the low detectability by conventional communications receiving equipment. A conventional receiver tuned to a fixed receiving frequency with conventional narrow bandwidth would only detect a very rapid swept signal. If the receiver beat frequency oscillator were turned on, only a "chirp" would be heard. A further novelty resides in the privacy feature as well as a reduction of potential interference by virtue of its ability to skip particular frequencies or frequency bands which are known to contain operating signals. A still further novelty is the capability for periodic, automatic sounding of the transmission properties of the ionosphere on a real time basis. This provides a determination of the maximum and minimum usable frequencies for specific transmission paths on a real time basis. Use of the frequencies near the maximum usable frequency provides an additional detection-proof feature since the ionospheric propagation characteristics would favor only the desired path in use. This communications technique provides an improved sensitivity over conventional communications technique by virtue of its narrow band operation and signal compression capabilities.

The communications technique of this invention provides the capability for a low susceptibility of position location of the transmitter by others. Present direction finding techniques require both fixed frequency operation and relatively long time for position location. Since the technique has a very rapidly changing instantaneous frequency, direction finding is prevented.

The communications technique of this invention also provides a unique capability for position location of the transmitter by a cooperative direction finding equipment. In the high frequency range, direction finding errors are caused by various causes, such as multipath and multimode transmission. This technique allows a bearing to be made upon the range of frequencies which are being transmitted and thus the bearings will be time-frequency composites more precise than a single short term DF bearing upon a single frequency signal. The range of frequencies, allowing a range of ionospheric paths (due to the frequency dependency of propagation), will thus allow a selection of the frequency and hence the propagation path which is not contaminated by multipath and multimode conditions.

The communications technique of this invention still further provides a capability for communications which is resistant to jamming and interference, both intentional and unintentional. A jamming signal would have to either follow the frequency of transmission precisely, or jam the whole spectrum of possible frequencies, both of which are not possible in the present state-of-the-art, with any degree of efficiency.

The communications technique of this invention also provides a capability for communications with all of the above characteristics which is suitable for all modes of radio communications, i.e., keyed continuous wave (A1); keyed amplitude modulation (A2); voice amplitude modulation (A3); frequency shift keying (F1); voice frequency modulation (F3); single sideband suppressed carrier (A3*a* and A3*b*).

An object of the present invention is to provide a privacy radio communication method and system utilizing coherent, continuously changing frequencies for keyed, pulsed, and voice communications.

Another object of the present invention is to provide a privacy radio communication method and system having the ability to change, on a coded, predetermined basis time versus frequency relationship of the transmissions on a continuous basis.

Still another object of the present invention is to provide a radio communications method and system wherein a synthesized, swept frequency signal imparts a privacy communication capability to the communications signal by virtue of the random or pseudo-random nature of the transmitted signal which is preprogrammed.

These and other advantages, features and objects of the invention will become more apparent from the following description taken in connection with the illustrative embodiments in the accompanying drawings.

DESCRIPTION OF THE DRAWING

FIG. 2*a* through 2*e* show in detail the types of modulators which may be utilized for the modulator of FIG. 1;

DETAILED DESCRIPTION OF THE PREFERRED EMBODIMENTS

One of the preferred embodiments of this invention is comprised of a swept frequency or "chirp" transmitter which allows variation of the frequency with time in accordance with preset commands, a means of controlling and generating the preset sweep frequency versus time curves; a means of impressing intelligence upon the transmitted signal, either pulsed or keyed, or voice communications; a broadband transmitting antenna; a receiver capable of following the swept frequency signal as transmitted; a means of demodulating the received signal; a means for synchronization of the transmitting and receiving frequencies; and a means of determination of the optimum frequency band.

Figure 1:
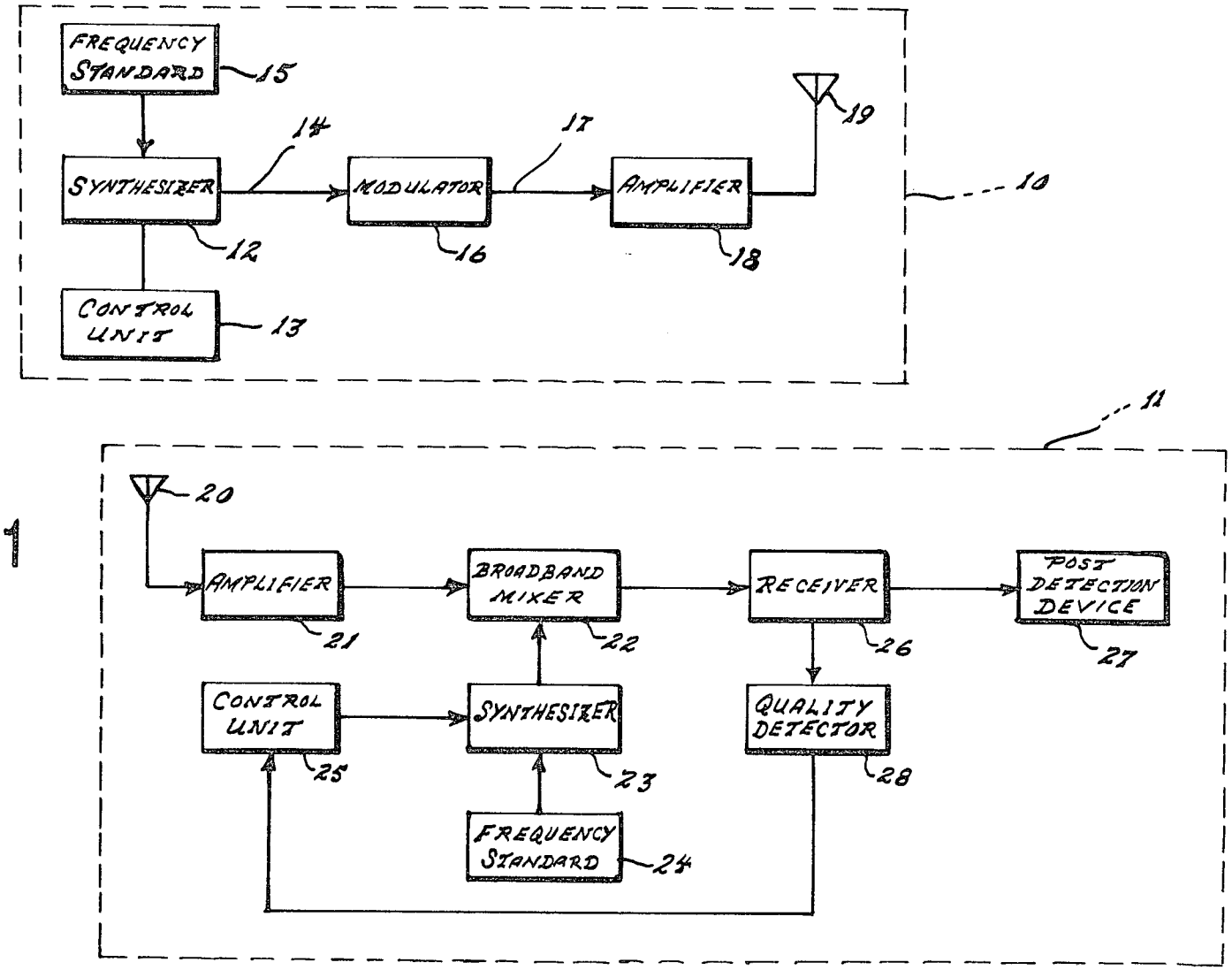
FIG. 1 shows in block diagram form an embodiment of the invention with a transmitter in one location and the receiver in another.

Now referring in detail to FIG. 1 which shows one of the preferred embodiments of the present invention, there is shown transmitter 10 and receiver 11. In the radio communication version of this system transmitter 10 is physically displaced in location from receiver 11. The following description will be applicable to the High Frequency (HF), Ultra High Frequency (UHF), and Very High Frequency (VHF) bands, but will be primarily directed to the HF band, which is most demanding due to the ionosphere mode of propagation.

Now referring to transmitter 10, there is shown conventional frequency synthesizer 12 which is designed for swept or "chirp" operation and is controlled in frequency by control unit 13. Control unit 13 may be any conventional general purpose digital computer with programs compatible with the synthesizer. The considerations to be met by this unit are the ability to very rapidly read memory storage to determine the increment of frequency change at any instant of time, and the capability to be preprogrammed. The frequency base for synthesizer 12 is conventional frequency standard 14 which is a very stable oscillator with facilities for correction of frequency drift. The frequency standard must be capable of maintaining frequency stability within the receiving station's bandwidth over a long period of time. For example, after synchronization of two frequency standards, one at the transmitter and the other at the receiver, the transmitter at one station starts to transmit. The receiver at the other station, with sweep synchronized to that of the first station, can then copy the transmitter output. If, however, the relative drift of the two synchronized frequency standards were to be greater than the band pass frequency of the receiver, when the transmitter starts to transmit, the receiver would be copying on a different frequency. However, if a difference of transmitting and receiving frequencies is noted during the transmission, it is possible to correct the frequency of a receiving synthesizer to correct for the difference. This correction capability is also required to compensate for time delays caused by propagation of the signal through the ionosphere.

The output signal from synthesizer 12 is fed by way of line 14 to modulator 16 which provides the means for impressing intelligence upon the signal to be transmitted by way of line 17. Modulator 16 may be any one of the conventional types shown in FIGS. 2*a* through 2*e*.

Now referring to FIG. 2*a* which shows apparatus for keyed continuous wave modulation in which the predetermined swept signal from synthesizer 12 is 15 fed to broadband keyed amplifier 16*a* by way of line 14. Keyer 16*b* keys the keyed amplifier 16*a* which then provides a keyed continuous signal by way of line 17.

FIG. 2*b* shows another type of apparatus for amplitude modulation in which broadband mixer 16*c* receives the output signal from the synthesizer by way of line 14. Broadband mixer 16*c* simultaneously receives a signal from AM signal generator 16*d*. Broadband mixer 16*c* provides an amplitude modulated signal by way of line 17.

FIG. 2*c* shows in block diagram form frequency/-phase modulation apparatus. Broadband mixer 16*e* receives the output signal from the synthesizer by way of line 14 and also receives a signal from FM/phase modulated oscillator 16*f*. Broadband mixer 16*e* then provides an FM/phase modulated signal by way of line 17.

Now referring to FIG. 2*d* which shows apparatus for frequency shift keying (FSK) modulator wherein broadband mixer 16*g* receives the synthesizer output signal by way of line 14 and simultaneously receives a signal from FSK exciter 16*h*. Broadband mixer 16*g* then provides an output signal by way of line 17.

Referring to FIG. 2*e*, there is shown in block diagram form a single sideband modulator wherein broadband mixer 16*i* receives the synthesizer output signal by way of line 14 and also simultaneously receives a signal by way of single sideband exciter 16*j*. Broadband mixer 16*i* then provides an output signal by way of line 17.

In a more detailed description of the above referenced modulators, for example, the frequency modulator is a conventional frequency modulated oscillator at some arbitrary radio frequency (for instance, 24 MHz). This modulated signal is then mixed with the input from the sweeping signal from the synthesizer, at for example 26 to 54 MHz. The mixer output (in this example a sweeping signal from 2 to 30 MHz) is then ready for further amplification. The frequency shift keyed and the single sideband suppressed carrier generator signals are similarly treated. The amplitude modulated signal may be generated conventionally by modulation of an amplifier with no mixer required, or for compatibility with other modes of modulation, it is possible to generate and modulate a signal with the same carrier frequency as the other modes. (In this example, 24 MHz). The same balanced mixer can then be used identical to the other modes.

In the receive mode the synthesizer frequencies may be identical to the transmit mode synthesizer frequencies. For example, the incoming received signal may sweep from 2 to 30 MHz. If the synthesizer sweeps from 26 to 54 MHz, the output from a balanced mixer would be fixed at 24 MHz.

Now referring again to transmitter 10 of FIG. 1, modulator 16 imparts communications information upon the sweeping frequency. The output signal from modulator 16 is fed through amplifier 18 to transmitting antenna 19. Amplifier 18 is a broadband device capable of linear amplification over the range of frequencies to be transmitted and antenna 19 is a broadband antenna capable of transmitting the frequencies generated by the transmitter.

Referring now to receiver 11 of FIG. 1 which is located at a position physically displaced from transmitter 10, there is shown receiving antenna 20 which is similar to transmitting antenna 19. Receiving antenna 20 is used to collect the incoming radio frequency signal. This may be the same antenna if the embodiment is used in the simplex mode. The received radio frequency signal is passed through broadband amplifier 21 to increase the level of the incoming signal. Broadband mixer 22 receives the output of amplifier 21. Frequency synthesizer 23, frequency standard 24, and control unit 25, are identical to in structure and operation to frequency synthesizer 12, frequency standard 15, and control unit 13, respectively, of transmitter 10. In a simplex mode frequency synthesizer 23, frequency standard 24, and control unit 25 may be the same units as used in transmitter 10.

Radio frequency broadband mixer 22 is used to mix the incoming amplified signal with the output of synthesizer 23. The output of synthesizer 23 in the receive mode has a different frequency from the incoming frequency by exactly the input frequency of conventional fixed tuned receiver 26 which is used as an intermediate frequency amplifier and detector. The detector within receiver 26 is appropriate for the type of modulation transmitted. The output of receiver 26 may then be used conventionally or be applied to post detection device 27 (e.g., radio teleprinter converters, etc.) Conventional signal quality detector 28 uses the output of receiver 26 to determine the quality of the signal. This may be either by a conventional measurement of the signal to noise ratio, the amplitude of the received signal, or similar signal thresholding techniques. When the quality of the signal is above an arbitrary threshold, the output of quality (threshold) detector 28 is applied to frequency control unit 25 to determine those frequencies which will provide the acceptable quality of communications. The use of the quality detector is on a command basis rather than continuously, thus it is designed to be turned on or off in its operation.

This invention includes the use of "chirp" type signals for secure communications. The sweeping signal may be swept at predetermined varying rates. The predetermination of sweep rate will allow the two ends of the communication link to be provided with a coded arrangement of various swept characteristics. Any listener without knowledge of this predetermined information would not know the sweep characteristics such as the low and high frequency limits of the sweep, any frequencies which were skipped between these extremes, the start time of transmission, the sweep rate, the frequency-time relationship (linear or nonlinear), the type of modulation, or the frequency bandwidth of the modulation. Thus, he would be unable to determine the intelligence on the signal. This predetermined coding is applied to control units 13 and 25 of FIG. 1.

Figure 3A:
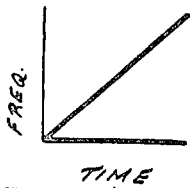
FIGS. 3*a* through 3*f* show a series of curves, each one of which represents a different type of intelligence impressed on a sweeping signal.
Figure 3C:
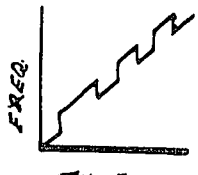
Figure 3E:
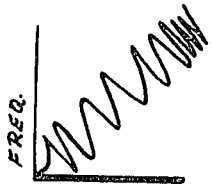
Figure 3B:
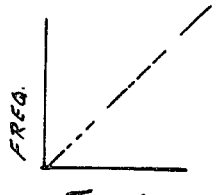
Figure 3D:
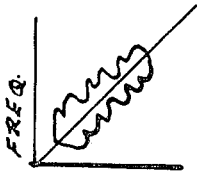
Figure 3F:
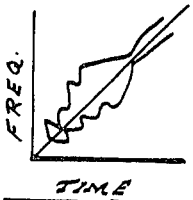

It is emphasized that the intelligence impressed upon the sweeping signal may be either coded or voice. FIG. 3*a* shows a linear sweeping continuous wave transmission without modulation or intelligence of any kind. FIG. 3*b* shows a continuous wave Morse code transmission. FIG. 3*c* shows a frequency shift signal as used in teleprinter and data transmission, based upon a linear sweep. FIG. 3*d* shows an amplitude modulated signal with the voice frequency modulating the linear sweep transmission. FIG. 3*e* shows a frequency modulated swept signal where the voice signal modulates the frequency of the linear swept signal from the "center frequency". FIG. 3*f*, shows a single sideband suppressed carrier signal based upon the linear sweep.

Figure 4A:
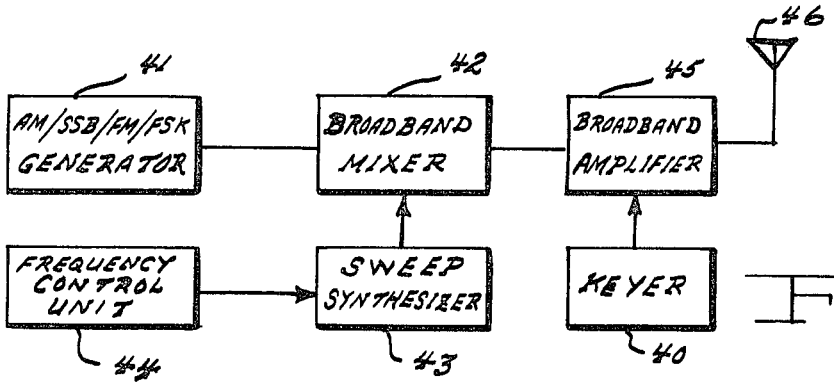
FIGS. 4*a* through 4*c* show in simplified block diagram form types of systems to put on and remove communications information.
Figure 4B:
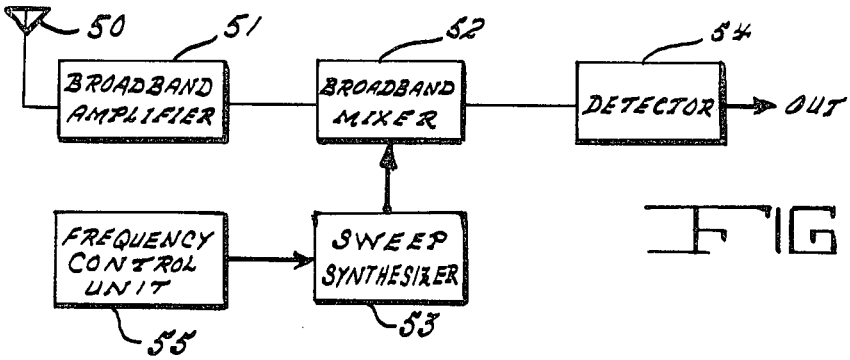
Figure 4C:
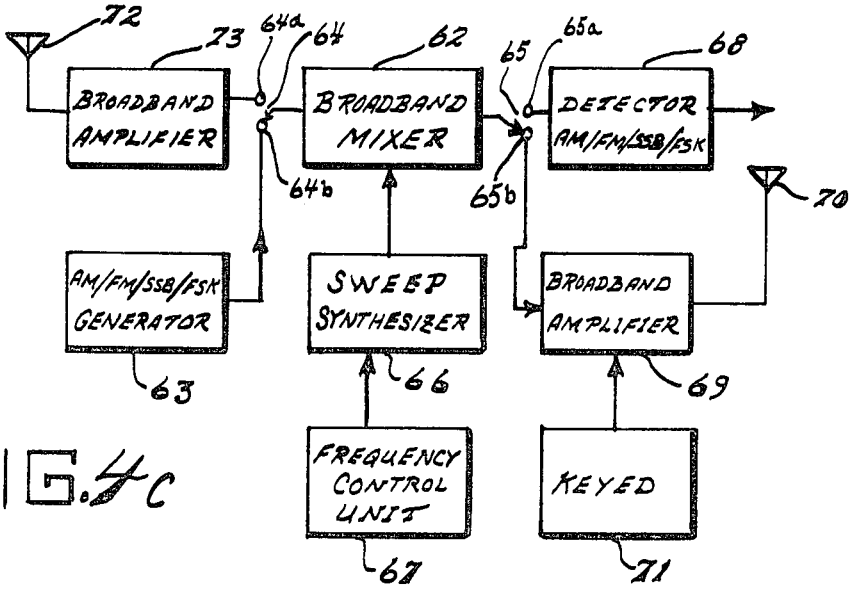

The communications information may both be put on and removed from the sweeping signal by the simplified apparatus shown in block diagram form in FIGS. 4*a* through 4*c*. In the transmit mode, shown in FIG. 4*a*, two types of modulation/keying are provided. For swept keyed continuous Morse code keyer 40 is activated and modulation generator 41 is not. For all voice communication modes, the modulation is applied by an appropriate modulation generator, either amplitude modulation, single sideband suppressed carrier, or frequency modulation. For radio teleprinter an audio frequency shift keyer may be added to the single sideband generator or a conventional frequency shift keyer may be used. The output of modulation generator 41 is mixed in balanced broadband mixer 42 with the output of radio frequency sweep synthesizer 43. The frequency versus time relationship is controlled by frequency control unit 44 which may be programmed for any desired relationship. The signal resulting from the mixing of the two signals is amplified by broadband amplifier 45 and radiated by broadband antenna 46.

FIG. 4*b* shows how the swept signal is to be received; broadband antenna 50 gathers the incoming radio signal and feeds it to broadband amplifier 51. The amplified signal is fed to broadband mixer 52 which mixes it with the output of sweep synthesizer 53. The resulting signal is applied to appropriate detector 54 to strip off modulation from the now-fixed frequency signal. Detector 54 may be a conventional receiver capable of demodulating the modulation type used. Frequency control unit 55 must generate a frequency versus time relationship to match the transmitted signals. The sweep signal transmitted and the swept signal at the receiving site must be synchronized by programming the frequency control units (digital computers). This requirement provides the basic capability for the privacy or secure communications feature. Unless a potential eavesdropper knows the proper frequency/time relationship and the absolute time of transmission, and has the equipment suitable for such rapid, coherent, frequency sweeping, he has no capability to determine the intelligence contained on the transmission. Further, since the signals may sweep in the order of 100 KHz per second, or more, the detectability of this signal is reduced for conventional receivers.

It is noted that there will be an improvement in the readability of high frequency signals through reduction of fading effects which are present in a conventional communication signal. These fading effects are caused by multipath propagation of the signal by the ionosphere. When the signal is delayed on one path by one-half wavelength more than another path, the two signals cancel. Since the signal is changing frequency continuously the receiving equipment can be synchronized to the signal mode arriving first. Through optimization of the receiving bandwidth, it is possible to reject those modes arriving later (i.e., at a different frequency), and thus prevent the interference and fading.

Now referring to FIG. 4*c*, switches 64 and 65 are utilized to permit simplex operation so that when switches 64 and 65 are in positions 64*b* and 65*b*, respectively, then transmissions occur. Modulation generator 63 delivers an input signal to mixer 62 and simultaneously the combination of frequency control unit 67 and sweep synthesizer 66 also delivers an input thereto. The output signal from mixer 62 is passed through broadband amplifier 69 for transmission by antenna 70. Modulation generator 63 may be turned off and keyer 71 may be turned on to keyer amplifier 69. In the receive mode, switches 64 and 65 are placed in positions 64*a* and 65*a*, respectively. Incoming signals from antenna 72 are fed by way of amplifier 73 to mixer 62 which simultaneously receives another input signal from the combination of frequency control unit 67 and sweep synthesizer 66. The output signal from mixer 62 is fed to detector 68 which provides the requisite signal.

Figure 6A:
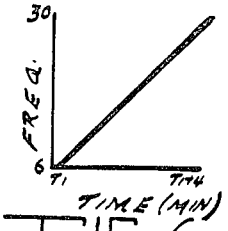
FIGS. 6*a* through 6*f* show a series of curves representing types of frequency against time relationships that may be utilized.
Figure 6B:
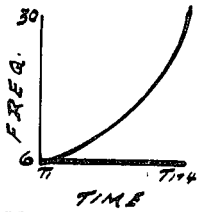
Figure 6C:
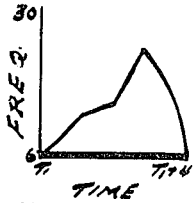
Figure 6D:
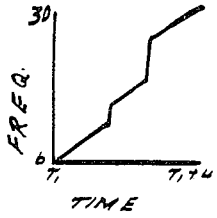
Figure 6E:
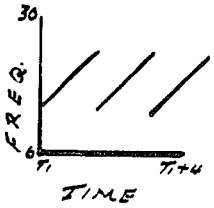
Figure 6F:
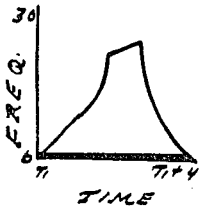
Figure 5:
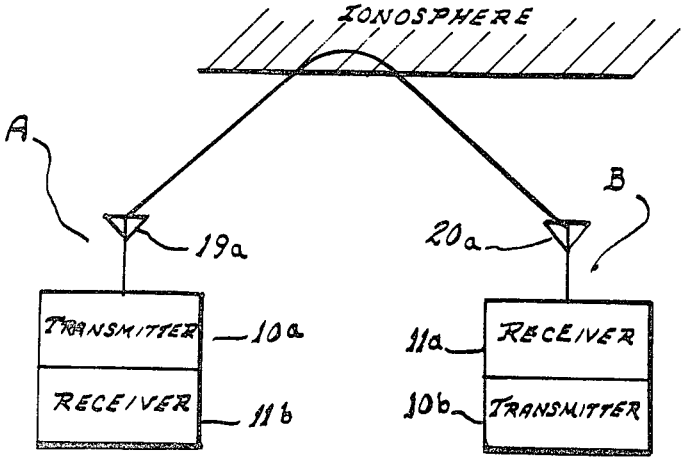
FIG. 5 shows in simplified block diagram form a transmitter and receiver located at one site and a second transmitter and receiver located at another site for a simplex mode of operation.

Referring to FIG. 5, there is shown a block diagram in simplified form of the simplex mode of operation including the transmitter and receiver shown in FIG. 1. Transmitter 10*a* and receiver 11*b* are in location A while receiver 11*a* and transmitter 10*b* are in location B. Intelligence is impressed upon the frequency varying signal by either coded pulses (Morse code or mark-space frequency shift keying) or by voice modulation (amplitude modulation, frequency modulation, or single sideband suppressed carrier). Through a variation of the relationship of the sweeping signal with time in random or pseudo-random fashion, a privacy or secure communications feature is imparted. The sweep frequency versus time relationship may be continuous-linear, continuous nonlinear, intermittent-linear, intermittent-nonlinear, or a combination of these. The curves of FIGS. 6*a, b, c, d, e* and *f* show some examples of these such as linear and continuous, continuous and nonlinear, intermittent linear with changing sweep rates, intermittent and linear with specific frequencies or bands of frequencies skipped, linear and repetitive over only a small portion of the possible frequency bands and combined linear and nonlinear curves, respectively.

Figure 7A:
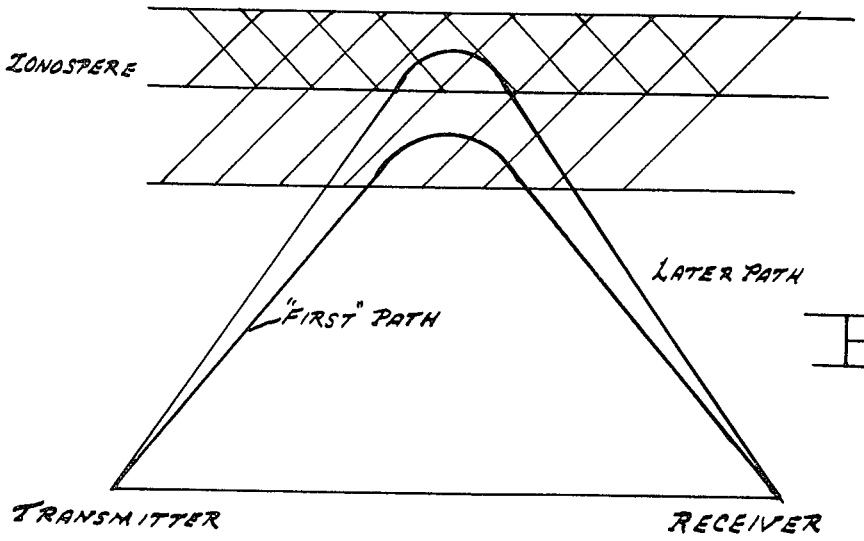
FIGS. 7*a* and 7*b* show curves of communication paths and curves of delays in the paths, respectively.
Figure 7B:
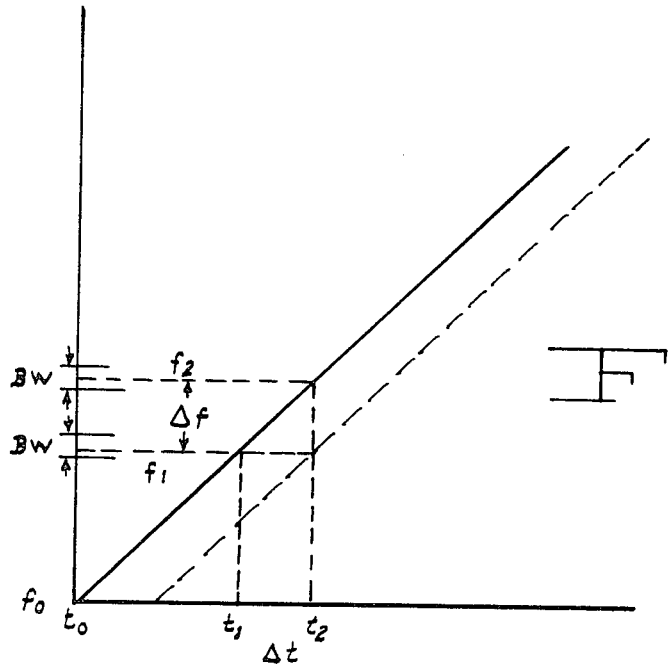

Much of the fading of radio signals is caused by the destructive interference of the signal with portions of itself which have been delayed by the propagation medium by integral multiples of one-half wavelength. In the high frequencies, these delays are caused by a multiplicity of propagation paths through the ionosphere while at higher frequencies reflecting surfaces cause spurious paths. The "first" mode to arrive is thus the one with the shortest path as shown by the curves in FIG. 7*a*. A frequency sweeping signal may be optimized for rejection of delayed signals since any late arriving signal may be optimized for rejection of delayed signals since any late arriving signals would be unable to maintain proper phase for cancellation, due to their different frequency as shown in the curve of FIG. 7*b*. The desired signal $F_1$ is transmitted at time $t_1$ and received by the receiver at time $t_1$, (after compensation for normal propagation for the "first" path). This same signal being propagated by a different path is delayed by t. Since the time t has elapsed from the instant of transmission of $f_1$, the sweep frequency has caused the new desired frequency to be at $f_2$. Now, if the bandwidth (BW) of the receiver is less than the frequency difference F, the receiver will not copy the interfering signal. Therefore, since the fading effects of the signal are reduced, the effective signal to noise ratio of the signal is increased, thus the required power for a particular path is reduced.

Figure 8A:
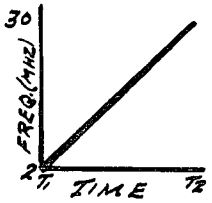
FIGS. 8*a* through 8*c* show a series of curves of frequency against time relationships utilized in the operation of the system shown in FIG. 5.
Figure 8B:
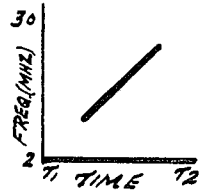
Figure 8C:
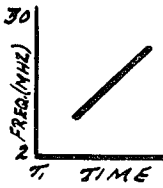

One feature of this invention is the use of the equipment as an ionospheric sounder for use with the high frequency range to determine the best operating frequency ranges by a simple interrogate-transpond technique, the communications equipment can determine its own frequency of operation (either automatically or on command). For example, at location A of FIG. 5, the transmitter would begin sweeping the full potential operating frequency at some arbitrary time such as shown in the curve of FIG. 8*a*. At location B, the receiver would receive the signal over the ionospherically propagated path only on those frequencies open for propagation. The quality of transmission would be determined according to some arbitrary standard such as signal to noise ratio. The transmitter at location B would then transmit a signal such as shown in the curve of FIG. 8*b* which would be only on the frequencies capable of supporting the communications, and would be able by means of predetermined coding to communicate which frequencies were used. Both locations would then resume communications operating only upon the restricted range of frequencies just determined such as shown in the curve of FIG. 8*c*. An added feature is that for a particular point-to-point communications path, only those frequencies very near the maximum usable frequency could be selected so that unintended potential listeners would be placed in the so-called "skip" zone and would be unable to receive the signal.

Figure 9:
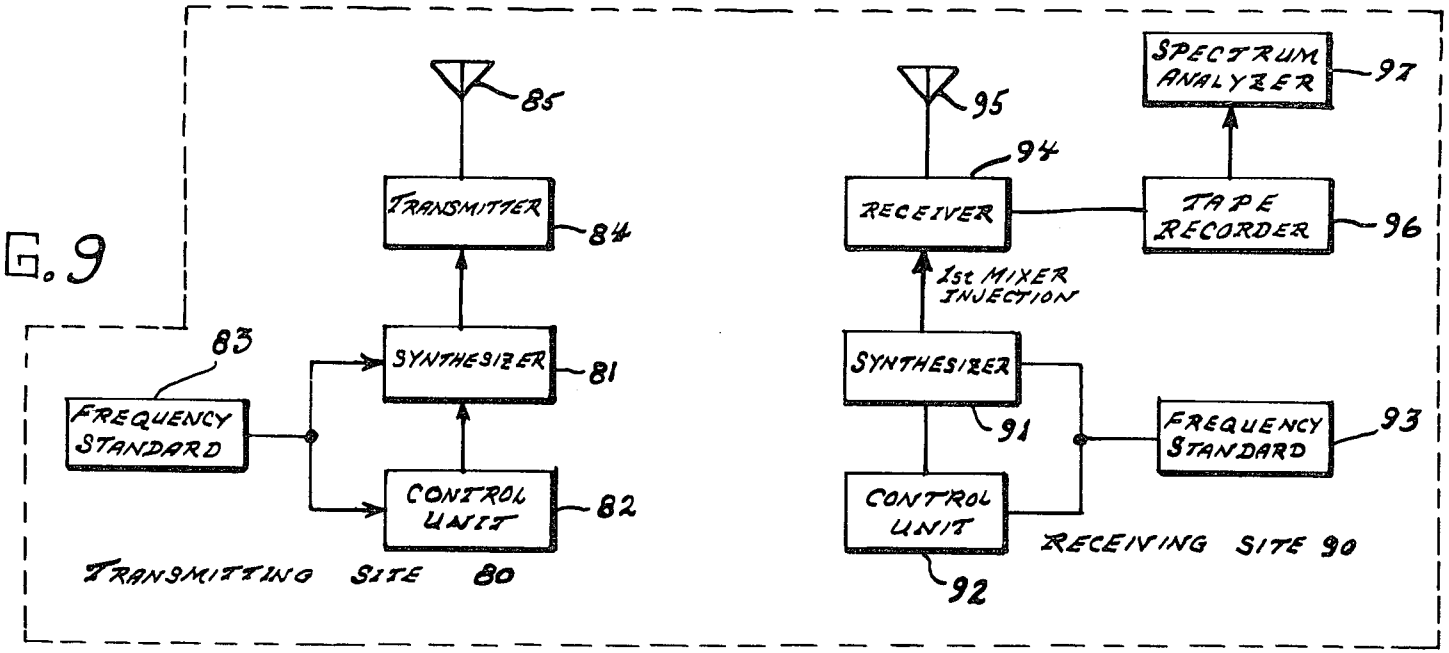
FIG. 9 shows in block diagram form an ionosphere sounding system.

Now referring to FIG. 9 illustrating the sounding system, in block diagram form, there is shown a transmitter at transmitting site 80 and a receiver at receiving site 90 wherein transmitting site 80 and receiving site 90 are comparable to locations A and B, respectively, of FIG. 5. The combination of synthesizer 81, control unit 82, and frequency standard 83 at site 80 and that of synthesizer 91, control unit 92, and frequency standard 93 are identical in structure and operation to the combination of synthesizer 12, control unit 13, and frequency standard 14, of FIG. 1. The output from synthesizer 81 is fed to transmitter 84 for transmission by antenna 85. It is noted that a linear sweeping signal is generated by successive switching of the synthesizer from one frequency to another. So that this sweep is truly a frequency sweep, the transitions from one frequency to another are made with phase continuity; i.e., the frequency changes are made at a point of the sine wave where both the old and the new frequencies are identical in phase.

In the sounding configuration, a continuous wave linearly swept signal is transmitted. The incoming signal is received by antenna 95 and is detected by receiver 94. Since the sweep of the transmitter frequency and the sweep of the receiver frequency are identical, the transmitted signal and the received signal would be identical in frequency (i.e., no frequency difference) if there were no spatial separation of the two sites. However, there is a separation of the two, with a delay caused by the propagation path and medium, and thus a frequency difference. Since the sounding frequency sweeps are linear, any frequency difference is proportional to the delay. Thus, frequency spectrum analyzer 97, receiving signals from receiver 94 by way of tape recorder 96, can be used for precise determination of signal delay and path, therefore, path length. Further, since the sounder signal is a continuous wave signal, compression techniques may be used and an improvement of the sensitivity may be had.

What is claimed is:

1. A privacy communication system comprising means of generating a signal continuously changing frequency with time in accordance with a preset relationship, said generating means being composed of a first frequency synthesizing means, a first digital computer connected to said frequency synthesizing means, said digital computer having the ability to very rapidly read memory storage to determine the increment of frequency change at any instant of time and also being preprogrammed in accordance with the preset relationship in frequency and in time, a first frequency standard serving as a frequency base for said frequency synthesizer means, said frequency standard maintaining frequency stability over an extended period of time, means to selectively impress intelligence upon said generated signal, means to transmit said signal impressed with said intelligence, means to receive the transmitted signal, said receiving means being physically displaced from said transmitting means, a mixer being fed the received signal as a first input signal, a second frequency synthesizing means identical to said first frequency synthesizing means, a second digital computer connected to said second frequency synthesizing means and identical in capability and preprogramming to said first digital computer, a second frequency standard also connected to said second frequency synthesizer means and identical to said first frequency standard, said first and second frequency standard initially being synchronized, said second frequency synthesizer providing a second input signal for said mixer, a receiver being fed the output signal from said mixer, said receiver being utilized as an intermediate frequency amplifier and detector, a post detection device receiving the output signal from said receiver for conversion to the initially impressed intelligence, and a threshold detector also receiving the output signal of said receiver and providing a control signal to said second digital computer.

2. A privacy communication system as described in claim 1 further including amplifier means interconnecting said receiving means and said mixer.

3. A privacy communication system having a first transmitter with a first receiver physically displaced therefrom comprising at said first transmitter a first frequency synthesizing means, a first digital computer connected to said first frequency synthesizing means, said first digital computer having the ability to very rapidly read memory storage to determine the increment of frequency change at any instant of time and also being preprogrammed in accordance with a preset relationship in frequency and time to provide a sweeping signal at predetermined varying rates to said first frequency synthesizing means, a first frequency standard serving as a preselected frequency base for said first frequency synthesizer means, said frequency standard maintaining frequency stability over an extended period of time, modulating means for impressing intelligence selectively upon the output signal from said first frequency synthesizing means, means for transmitting the signal from said modulating means, at said first receiver, antenna means for receiving the transmitted signal, mixer means being fed a first input signal the received signal, second frequency synthesizer means identical to said first frequency synthesizer means, a second digital computer connected to said second frequency synthesizing means and identical in capability and preprogramming to said first digital computer, said first and second digital computers providing sweeping signals at predetermined varying rates allowing said first transmitter and said receiver to be provided with an identical coded arrangement of various swept characters, a second frequency standard connected to said second frequency synthesizer, said first and second frequency standards being identical and initially being synchronized, said second frequency synthesizer providing a a second input signal for said mixer means, receiver means being fed the output signal from said mixer means, a post detection device receiving the output signal from said receiver means for conversion to said impressed intelligence, and threshold detector means set at a predetermined level, said threshold detector also receiving the output signal from said receiver means and providing in response thereto a control signal to said second digital computer to determine those frequencies providing acceptable quality of communications.

4. A privacy communication system as described in claim 3 further including, at said first transmitter, a second receiver identical to said first receiver and first means to alternately transmit and receive thereat, at said first receiver, a second transmitter identical to said first transmitter and second means to alternately receive and transmit thereat.

5. A privacy communication system having a transmitter with a receiver physically displaced therefrom for sounding being comprised of at said transmitter first frequency synthesizing means, first digital computer connected to said first frequency synthesizing means, said first digital computer having the ability to very rapidly read memory storage to determine the increment of frequency change at any instant of time and also being preprogrammed in accordance with a preset relationship in frequency and time to provide a sweeping signal at predetermined varying rates to said first frequency synthesizing means to provide therefrom a continuous wave linearly swept signal, first frequency standard serving as a preselected frequency base for said first frequency synthesizer and said first digital computer, means for transmitting the output from said first synthesizing means for transmission to said receiver by way of the ionosphere, at said receiver, antenna means receiving the transmitted signal, means to receive said transmitted signal, second frequency synthesizer means identical to said first frequency synthesizer means, a second digital computer connected to said second frequency synthesizing means and identical in capability and preprogramming to said first digital computer, said first and second digital computers providing linear sweeping signals with frequency changes being made at a point of a sine wave where both old and the new frequencies are identical in phase, a second frequency standard connected to said second frequency synthesizer and said second digital computer, said first and second frequency standards being identical and initially being synchronized, said second frequency synthesizer providing an injection signal to said receive means, and a spectrum analyzer receiving the output signal from said receive means to precisely determine signal delay and path length.

6. A privacy communication system for simplex operation comprising at a first site, and also at a second site physically displaced from said first site, antenna receiving means, a first broadband amplifier connected to said antenna receiving means, modulation generator means, a broadband mixer, a sweep frequency synthesizer connected to said broadband mixer, a digital computer connected to said sweep frequency synthesizer, said digital computer having the capability to very rapidly read memory storage to determine the increment of frequency change at any instant of time and also being preprogrammed in accordance with a preset relationship in frequency and time to provide a sweeping signal at predetermined varying rates to said sweep frequency synthesizer, detector means, a second broadband amplifier, means to key said second broadband amplifier, transmitting antenna means connected to said second broadband amplifier, first switching means to alternately connect said broadband mixer to said first broadband amplifier and said modulation generator means, and second switching means to alternately connect said broadband mixer to said detector and said second broadband amplifier.

* * * * *